US009687964B2

(12) United States Patent
Givens

(10) Patent No.: US 9,687,964 B2
(45) Date of Patent: Jun. 27, 2017

(54) POLISHING PAD WITH HYBRID CLOTH AND FOAM SURFACE

(71) Applicant: Showroom Polishing Systems LLC, Dayton, OH (US)

(72) Inventor: David Givens, Dayton, OH (US)

(73) Assignee: SHOWROOM POLISHING SYSTEMS LLC, Dayton, OH (US)

( * ) Notice: Subject to any disclaimer, the term of this patent is extended or adjusted under 35 U.S.C. 154(b) by 428 days.

(21) Appl. No.: 14/506,180

(22) Filed: Oct. 3, 2014

(65) Prior Publication Data

US 2016/0096253 A1 Apr. 7, 2016

(51) Int. Cl.
*B24D 13/14* (2006.01)

(52) U.S. Cl.
CPC ..... *B24D 13/142* (2013.01); *B24D 13/147* (2013.01)

(58) Field of Classification Search
CPC ..... B24D 13/142; B24D 13/147
USPC ..... 451/59, 57, 921, 461
See application file for complete search history.

(56) References Cited

U.S. PATENT DOCUMENTS 3,862,522 A 1/1975 Mednick et al.
4,962,562 A 10/1990 Englund et al.
5,389,032 A * 2/1995 Beardsley ..... B24D 7/14 451/359
5,944,586 A * 8/1999 Sevigny ..... B24D 7/04 451/359
7,404,988 B2 * 7/2008 Kuta ..... B29C 73/00 216/53
8,117,709 B2 * 2/2012 McLain ..... B24D 9/085 15/230
9,089,943 B2 * 7/2015 Lipson ..... B24D 7/18
2006/0107482 A1 5/2006 Krause et al.

OTHER PUBLICATIONS

International Search Report and Written Opinion dated Dec. 22, 2015 pertaining to International Application No. PCT/US2015/053688.

* cited by examiner

*Primary Examiner* — Robert Rose
(74) *Attorney, Agent, or Firm* — Porter Wright Morris & Arthur LLP

(57) ABSTRACT

Polishing pad for use with high-speed mechanical buffers or for use by hand. More specifically, a polishing pad and methods of use for the polishing pad, the polishing pad having a foam pad, and having a cloth, a foam, or both attached to a top surface of the foam pad, with the cloth, the foam, or both covering part of the top surface of the foam pad such that gaps in the coverage allow for the foam pad and either the cloth, the foam, or both to touch a polishing surface at the same time.

15 Claims, 11 Drawing Sheets

POLISHING PAD WITH HYBRID CLOTH AND FOAM SURFACE

FIELD

This application relates generally to polishing pads and methods of use thereof. More specifically it relates to polishing pads having a foam pad with a cloth or a foam or both attached to a top surface of the foam pad, the cloth or the foam or both covering part of the top surface of the foam pad such that gaps in the coverage provided by the cloth or the foam or both allow for the foam pad and either the cloth or the foam or both to touch a polishing surface at the same time.

BACKGROUND

Restoring a surface, such as a paint surface of a car, to a state that is nearly indistinguishable from new has traditionally been a multiple step process requiring an in-depth understanding of paint types, hardnesses, and proper mechanical buffers, polishers, and polishes to complete the process.

Sand paper has been used to remove scratches from paint, but results in markings from the sand paper and leaves a lack of luster.

Polishing a surface with wool can remove some markings from the sand paper, but leaves markings from the wool that leave a surface imperfect, and can lead to damage to the surface if a user is not skilled and properly trained in use. The wool can be used with mechanical buffers that can provide the advantage of speed, but require knowledge for use or can lead to damage to a surface, including in some cases removing a large amount of a paint base coat. There has been a long-felt need in the art for methods of polishing that do not remove the paint base coat.

There has been a long-felt need in the art for simpler, more effective ways of polishing surfaces. Embodiments described herein provide for such needs and provide surprising results.

SUMMARY

Specific embodiments herein provide for a polishing pad for use with high-speed mechanical buffers or for use by hand comprising: a foam pad; and at least one of a cloth and a foam that are each different in abrasiveness than the foam pad coupled to a top surface of the foam pad, the at least one of the cloth and the foam covering part of the top surface of the foam pad such that gaps in the coverage provided by the at least one of the cloth and the foam allow for the foam pad and the at least one of the cloth and the foam to touch a polishing surface at the same time.

Specific embodiments herein provide for a method of removing imperfections from a polishing surface comprising: providing a polishing pad, the pad comprising: a foam pad; and a cloth coupled to a top surface of the foam pad, the cloth covering part of the top surface of the foam pad such that gaps in the coverage provided by the cloth allow for the cloth and the foam pad to touch the polishing surface at the same time; and polishing the polishing surface with the polishing pad such that cloth and the foam pad touch the polishing surface at the same time.

Specific embodiments herein provide for a method of removing imperfections from a polishing surface comprising: providing a polishing pad, the pad comprising: a foam pad; and a cloth coupled to a top surface of the foam pad, the cloth covering part of the top surface of the foam pad such that gaps in the coverage provided by the cloth allow for the cloth and the foam pad to touch the polishing surface at the same time; performing at a point of the imperfection at least one of: sanding the polishing surface, or applying a high-speed mechanical buffer to the polishing surface with either a pad with a solid top surface of foam and cloth; and polishing the polishing surface with the polishing pad such that cloth and the foam pad touch the polishing surface at the same time, the polishing surface being a surface of paint from at least one of a car, a boat, or an airplane.

DETAILED DESCRIPTION

Figure 1:
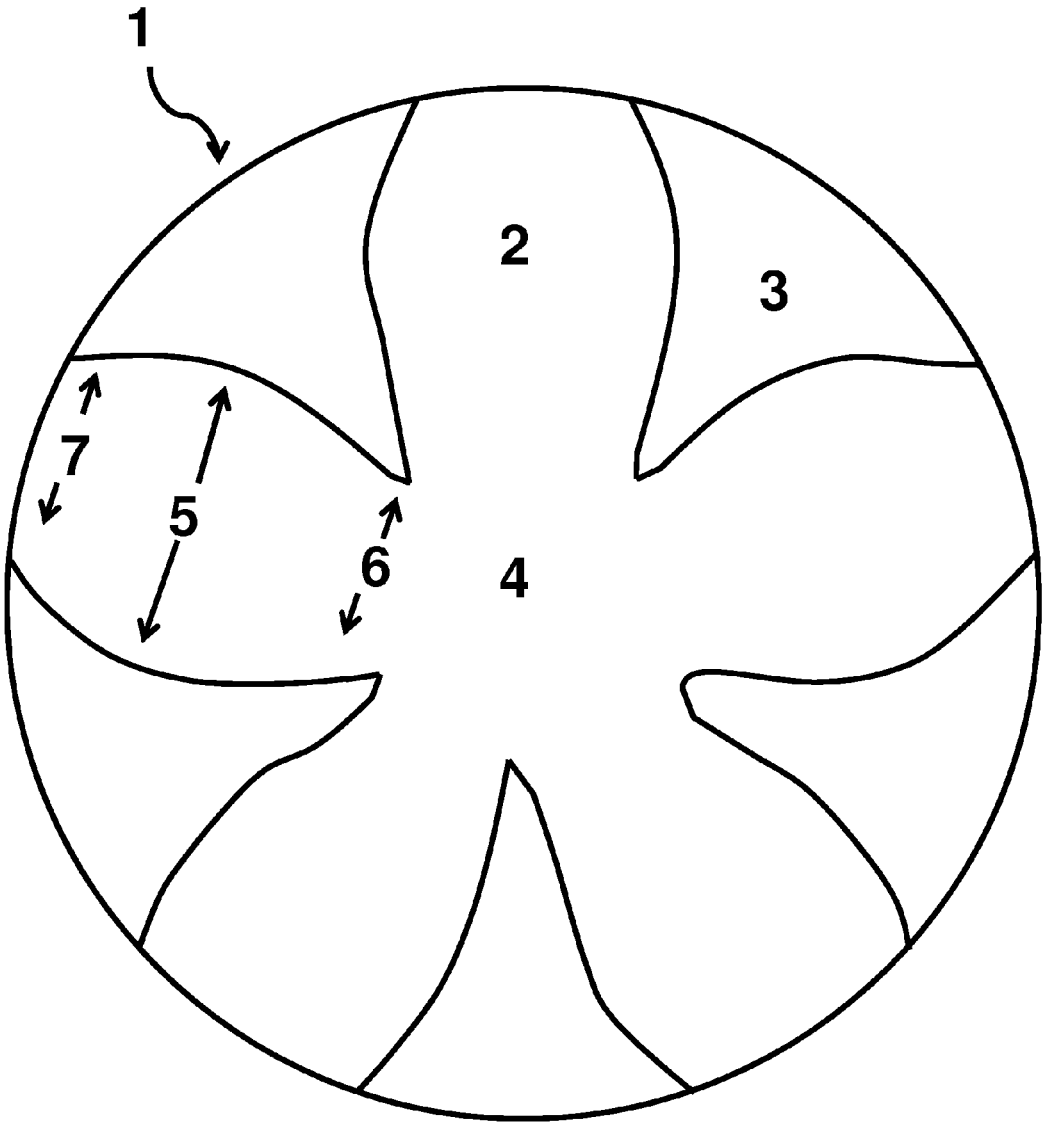
FIG. 1 illustrates an embodiment of a polishing pad as described herein demonstrating the foam pad with a cloth, and also illustrating the top surface with gaps.

Specific embodiments of the present disclosure will now be described. The invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which embodiments of this invention belong. The terminology used herein is for describing particular embodiments only and is not intended to be limiting of the invention. As used in the specification and appended claims, the singular forms "a," "an," and "the" are intended to include the plural forms as well, unless the context clearly indicates otherwise.

Unless otherwise indicated, all numbers expressing quantities of ingredients, properties such as molecular weight, reaction conditions, and so forth as used in the specification and claims are to be understood as being modified in all instances by the term "about," which is intended to mean up to ±10% of an indicated value. Additionally, the disclosure of any ranges in the specification and claims are to be understood as including the range itself and also anything subsumed therein, as well as endpoints. Unless otherwise indicated, the numerical properties set forth in the specification and claims are approximations that may vary depending on the desired properties sought to be obtained in embodiments of the present invention. Notwithstanding that numerical ranges and parameters setting forth the broad scope of embodiments of the invention are approximations, the numerical values set forth in the specific examples are reported as precisely as possible. Any numerical values, however, inherently contain certain errors necessarily resulting from error found in their respective measurements.

Parts of methods described herein such as mathematical determinations, calculations, inputting of data for computations or determinations of equations or parts thereof can be performed on parts of or one or more computers or computer systems that can include one or more processors, as well as software to run or execute programs and run calculations or computations.

As described herein, embodiments can be used with one or more high-speed mechanical buffers. A "high-speed mechanical buffer" herein refers to one or more of a rotary machine/rotary buffer, direct drive tools, orbit/orbital polishers, flexible rotary, dual action polishers, cyclopolishers, and/or a machine with a single or dual head or more than two heads, or machines with a rotating spindle assembly, or combinations thereof.

As used herein, "cloth" refers to any microfiber, cotton, microfiber, polyester, polyamide, and polypropylene, wool, hair, silk, flax, or other fiber known in the art for polishing, or a combination thereof.

As used herein, "top surface" of a polishing pad refers to the surface configured to touch a polishing surface.

As used herein, a "solid top surface" refers to a surface having about one-hundred percent coverage of a material or materials as described herein. For example, a solid top surface of the polishing pad as described herein can comprise foam and cloth as described herein, the cloth and foam together having about one-hundred percent coverage of the top of the polishing pad. This coverage can be any pattern known in the art.

FIG. 1 illustrates an embodiment of a polishing pad 1 as described herein demonstrating the foam pad 3 with a cloth 2, and also illustrating the top surface with gaps. The polishing pad 1 is shown, with a cloth covering 2 having gaps that are areas of the top surface of the foam pad 3, and a central cloth covering area 4. In specific embodiments the cloth 2 has a section extending out from the central cloth covering area such that the portion near the center having a width 6 extends toward the periphery and increases in width (shown as middle width 5) and then decreases in edge width 7. In specific embodiments the extending sections of cloth 2 are from about 1 to about 10 or from about 1 to about 5, or from about 5 to about 10, or 1, 2, 3, 4, 5, 6, 7, 8, 9, 10, or more in number. In specific embodiments there are gaps on each side of each extension of cloth 2. In specific embodiments the extensions of cloth 2 have equal diameters from the center extending out to the edge of the top surface of the polishing pad, the width of each extending cloth strip being equal. In specific embodiments the extending cloth 2 sections take on the shape of a star. A foam covering the top of the foam pad can take the configuration of any pattern and/or configuration of the cloth 2 or the gaps as described herein.

Figure 2:
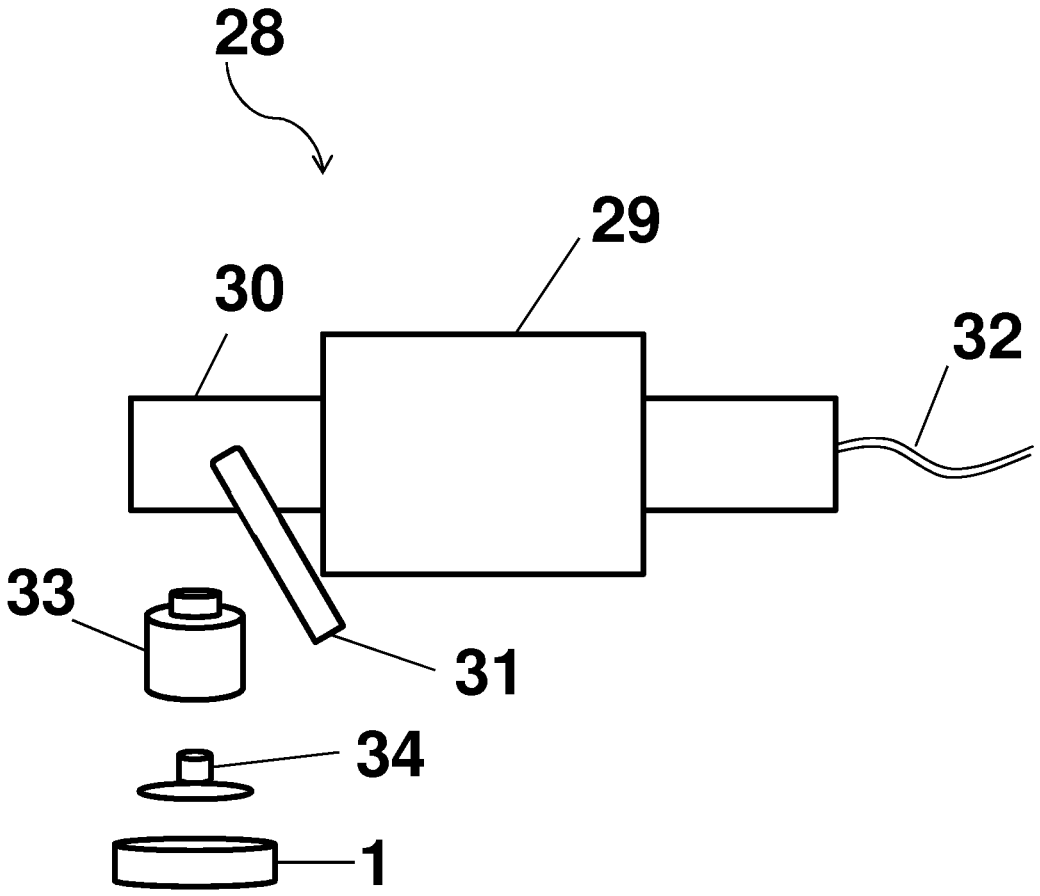
FIG. 2 illustrates an embodiment of a high-speed mechanical buffer as used with a polishing pad as described herein.

FIG. 2 illustrates an embodiment of a high-speed mechanical buffer 28 as used with a polishing pad 1 as described herein. Shown is the high-speed mechanical buffer 28 having a body 29, a front section 30, a handle 31, and a cord 32, the front section 30 being couplable to a buffer head 33, optionally an intermediate piece 34, and a polishing pad 1.

Figure 3A:
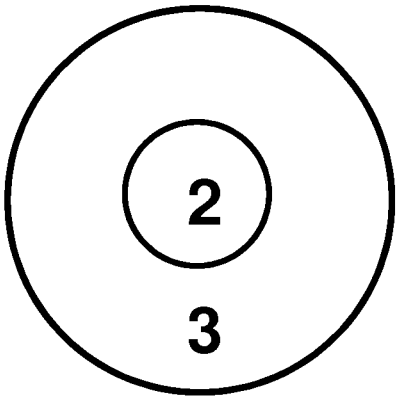
FIGS. 3A-3F illustrate various embodiments of a polishing pad as described herein, demonstrating various cloth arrangements.
Figure 3B:
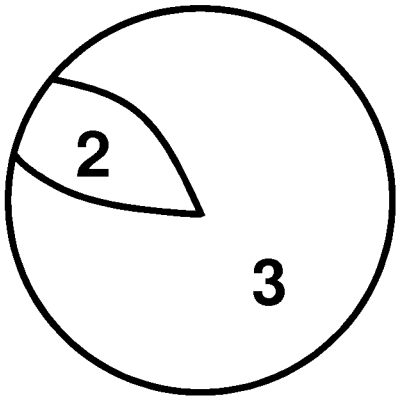
Figure 3C:
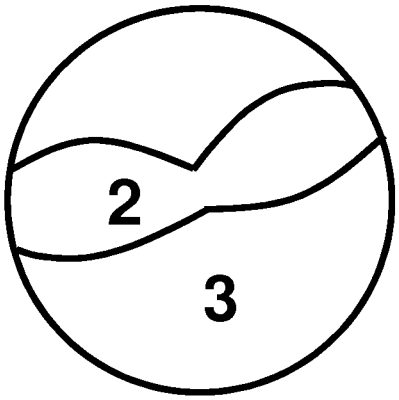
Figure 3D:
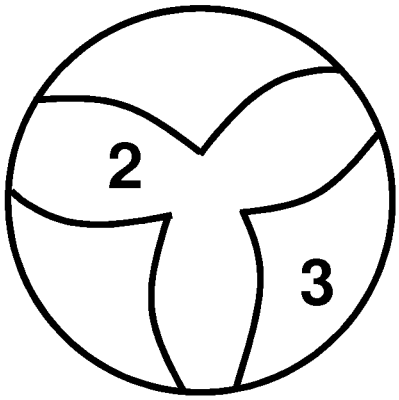
Figure 3E:
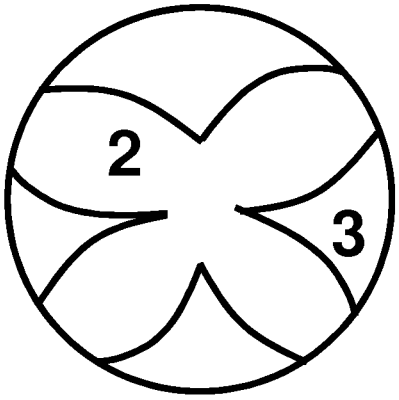
Figure 3F:
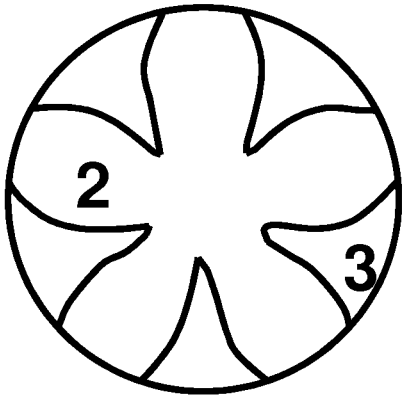
Figure 4A:
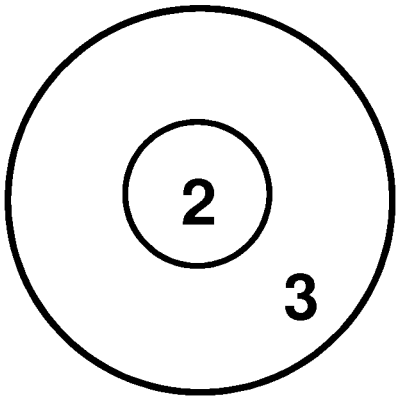
FIGS. 4A-4F illustrate various embodiments of a polishing pad as described herein, demonstrating various cloth arrangements with a common, central covering.
Figure 4B:
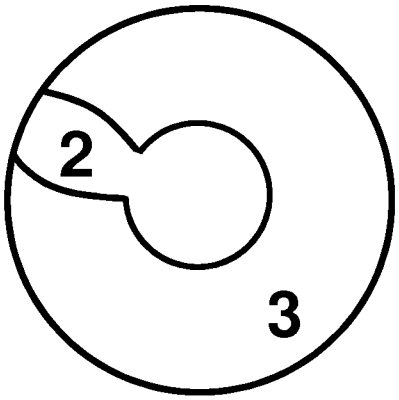
Figure 4C:
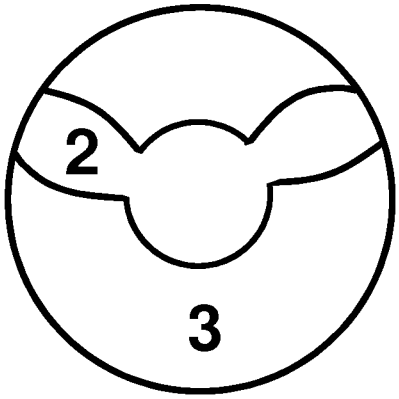
Figure 4D:
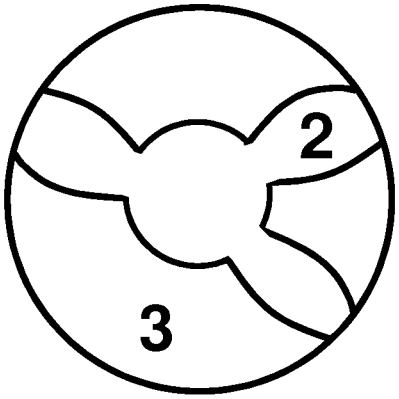
Figure 4E:
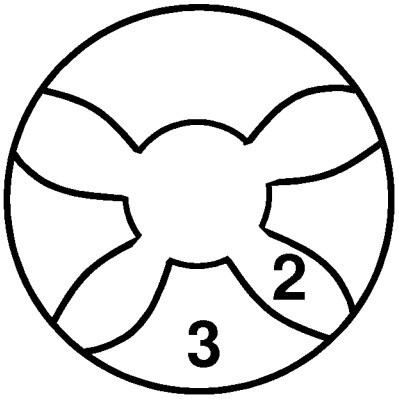
Figure 4F:
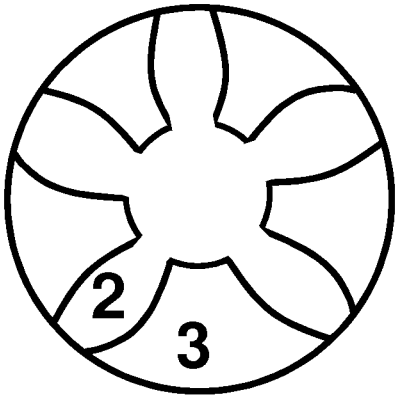

FIGS. 3A-3F illustrate various embodiments of a polishing pad as described herein, demonstrating various cloth arrangements. FIG. 3A shows a top view of a pad 1 showing the foam 3 with a cloth 2 covering that is central. FIG. 3B illustrates another top view of the polishing pad 1 showing the foam 3 with a cloth 2 covering extending out from about the center of the top of the pad 1 to the periphery of the polishing pad 1. In specific embodiments the cloth 2 has a smallest width at about the center of the polishing pad 1 as viewed from the top, then extends toward the periphery of the polishing pad 1, having a greater cloth 2 middle width than edge width or central width. FIG. 3C, illustrates a cloth covering as in FIG. 3B, but with a second main area of coverage, and two gap areas (the areas not covered by cloth). FIG. 3D illustrates a cloth covering as in FIG. 3B, but with a third main area of coverage, and three gap areas. FIG. 3E illustrates a cloth covering as in FIG. 3B, but with a fourth main area of coverage, and four gap areas. FIG. 3F illustrates a cloth covering as in FIG. 3B, but with a fifth main area of coverage, and five gap areas.

FIGS. 4A-4F illustrate various embodiments of a polishing pad as described herein, demonstrating various 2 cloth arrangements with a common, central covering. FIGS. 4A-4F show a central cloth covering that in specific embodiments is approximately circular, with from 1 to 5 areas of cloth 2 coverage extending out to the periphery.

Figure 5:
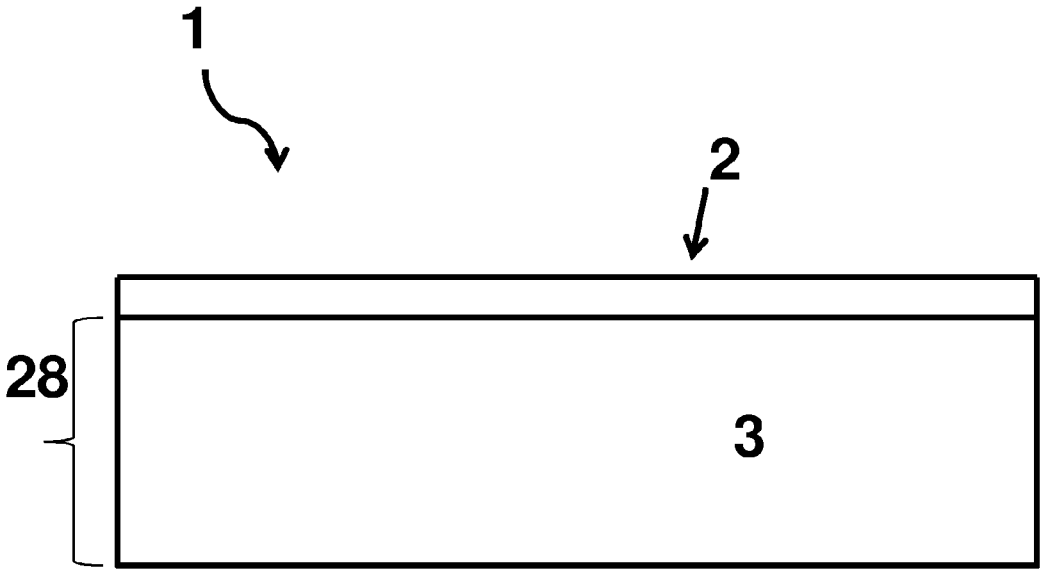
FIG. 5 illustrates a side view of the polishing pad, showing the pad and the cloth.

FIG. 5 illustrates a side view of the polishing pad 1, showing the polishing pad 1 and the cloth 2 attached to the foam 3, and showing the thickness 28 of the foam pad 3. The cloth 2 is located in specific embodiments on the top surface of the foam pad 3. In specific embodiments the top surface (the surface facing outward from the foam pad and toward a surface to polish) of the foam pad 3 and all fibers of the cloth 2 are at the same level. For example the foam pad 3 can be cut so as to have an impression of the cloth 2, which sits exactly into the impression. In other embodiments the top surface of the cloth 2 extends in part or in full above from the foam pad 3 (such as one of more fibers).

Figure 6A:
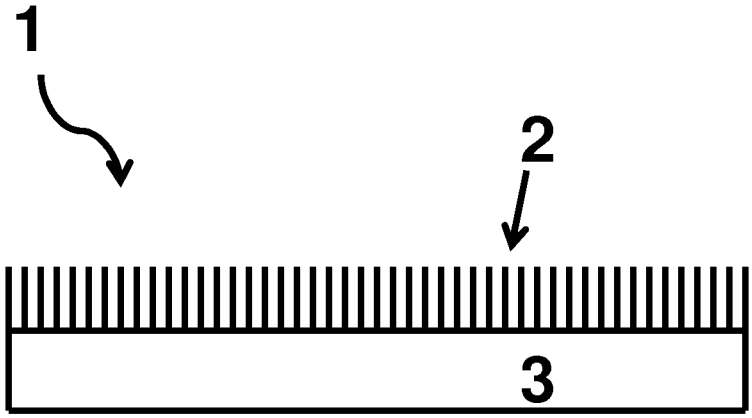
FIGS. 6A-6C illustrate an enlarged view of the cloth looking at a side view, demonstrating various embodiments of the cloth fibers.
Figure 6B:
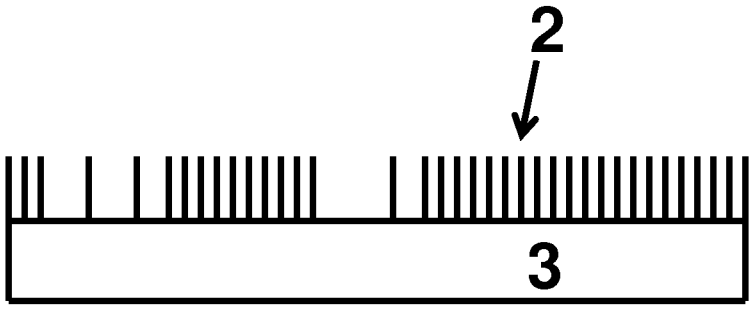
Figure 6C:
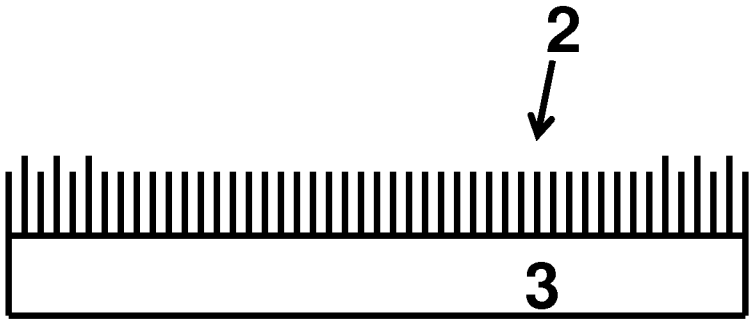

FIGS. 6A-6C illustrates an enlarged view of the cloth 2, demonstrating various embodiments of the cloth 2 fibers. FIG. 6A shows the polishing pad 1, with cloth 2, and foam 3, the cloth 2 having fibers. FIG. 6A shows the fibers of the cloth 2 equally spaced, and in FIG. 6B the fibers are unequally spaced in part and equally spaced in others. In specific embodiments the fibers of the cloth 2 can all be equally spaced, all be unequally spaced, or a combination thereof. FIG. 6C illustrated fibers of the cloth having different lengths. In specific embodiments the lengths of fibers for a cloth 2 or part of a cloth can all be equal in length, all be unequal in length, or a combination thereof. In specific embodiments the lengths are in part equal and in part unequal in length, and in part equally spaced and in part unequally spaced. In specific embodiments of the polishing pad 1 as described herein, the length of the fibers of the cloth 2 can be configured such that an initial polishing is performed with only the cloth 2 touching the polishing surface, and upon additional force being provided toward the polishing surface by the high-speed mechanical buffer 28, the cloth 2 fibers bend, and the foam pad 3 then touches the polishing surface, and the polishing in the second step involves touching of the foam pad 3 and the cloth 2 at the same time to the polishing surface. In specific embodiments the cloth 2 can be recessed into the foam pad 3 and/or into openings in the top surface of the foam pad 3 such that the only the foam pad 3 first touches a polishing surface, and upon additional force being provided by a high-speed mechanical buffer 28 when polishing a polishing surface, the cloth 2 fibers and the foam pad 3 touch the polishing surface at the same time. In specific embodiments of the foam pad at rest, the top of a fiber of the cloth 2 may rest about 0.1 to about 0.5 inch below the foam pad surface in at least one recess in the top surface of the foam pad 3. In specific embodiments there are about 1 to about 5 recesses or from about 1 to about 10 recesses.

Figure 7:
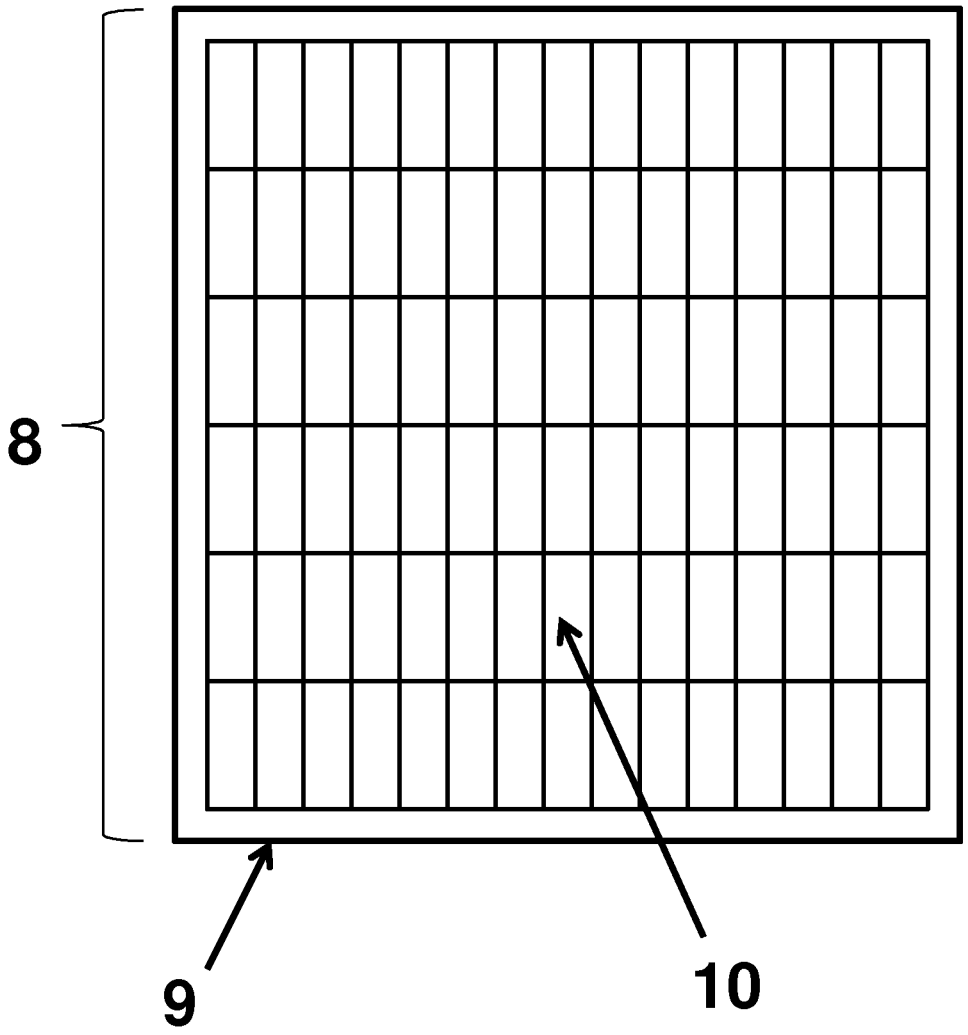
FIG. 7 illustrates a microfiber surface as shown from the top, a surface which could be used, at least in part, on the top of a foam pad.

FIG. 7 illustrates a microfiber surface 8 as shown from the top, a surface which could be used, at least in part, on the top of a foam pad 3. Illustrated is an edging 9 and fibers 10, which can be of the square, rectangular, or other shape, or can be fibers that are laid down so as to have a rectangular-look as viewed from the top (for example the shown rectangles could be in a laid down position such as from top to bottom of the viewed figure so that when rubbed against an opposing surface, the position of the fiber changes, and the fiber stands on end, wherein the end sticking outward from the pad can be a rectangular shape or other shape such as a circle such that each fiber had a cylindrical shape).

Figure 8A:
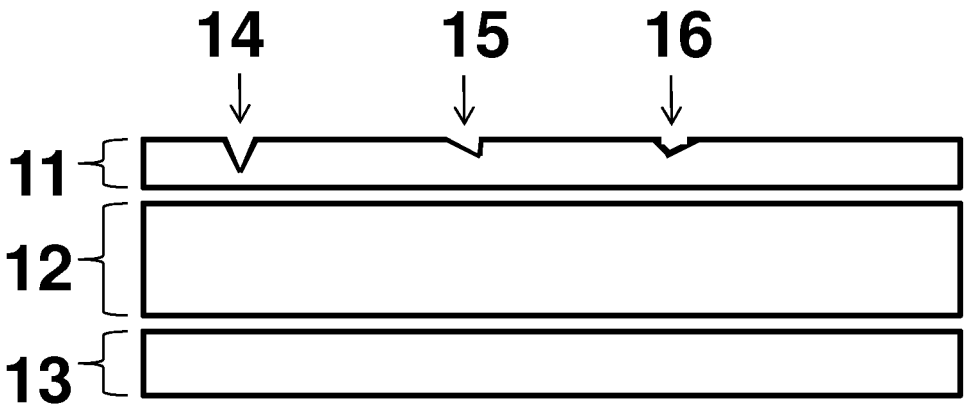
FIGS. 8A-8B illustrate an embodiment of a paint surface, such as for a car, showing imperfections such as scratches (8A), and illustrating an embodiment of a paint surface, such as for a car, after scratches have been removed (8B).
Figure 8B:
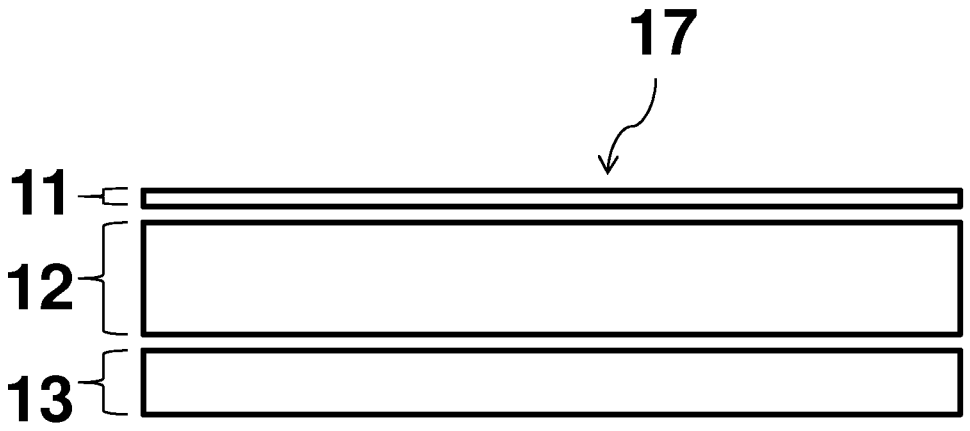

FIGS. 8A-8B illustrate an embodiment of a paint surface, such as for a car, showing imperfections such as scratches (8A), and illustrating an embodiment of a paint surface, such as for a car, after scratches have been removed (8B). In specific embodiments the paint has a clear coat 11, a basement coat 12, and a primer 13. Various imperfections 14, 15, 16 such as scratches are shown in the clear coat 11 of FIG. 8A. An aim of current embodiments provided herein is to remove such imperfections, which is shown in FIG. 8B. As shown in FIG. 8B, the imperfections 14, 15, 16 are gone, and a smooth surface 17 remains. In this embodiment, the clear coat 11 is thinner, as some of the clear coat 11 is removed to smooth the surface. In specific embodiments a minimal amount of the clear coat 11 is removed. In specific embodiments no clear coat 11 is removed, with the polishing only reorganizes molecules of the coat to smooth. In specific embodiments the outer surface is a paint base surface, and in specific embodiments described herein, no paint is removed; only the molecules of the paint are reorganized to smooth.

Figure 9:
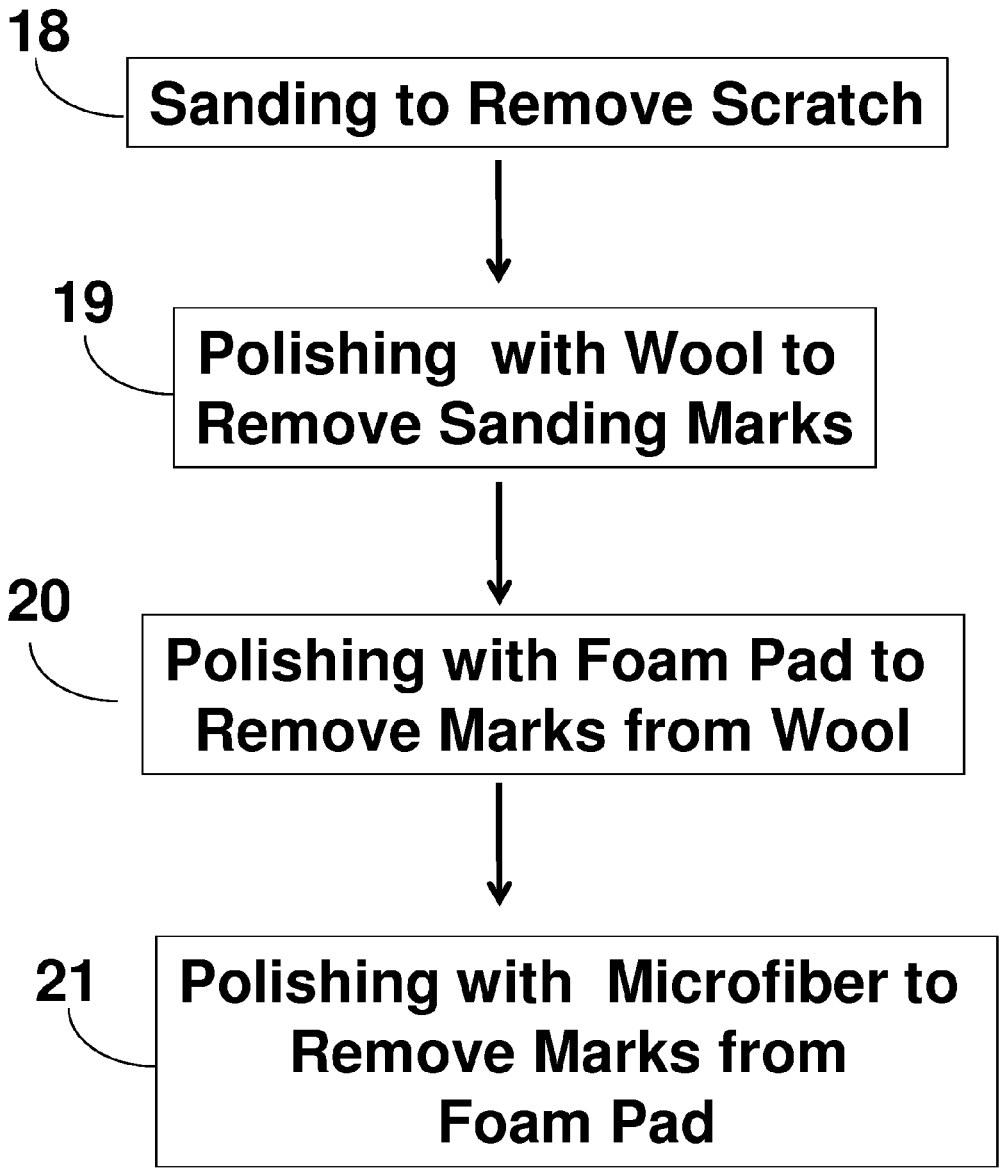
FIG. 9. illustrates an example method of polishing a paint surface to remove a scratch or other irregularity.

FIG. 9 illustrates an example method of polishing a paint surface to remove a scratch or other irregularity. Sanding 18 is performed to remove a scratch, polishing 19 with wool is performed to remove sanding marks, polishing 20 is performed with a foam pad 3 to remove marks from the wool polishing 21, and polishing 22 is performed with a microfiber surface to remove marks from the polishing with the foam pad.

Figure 10:
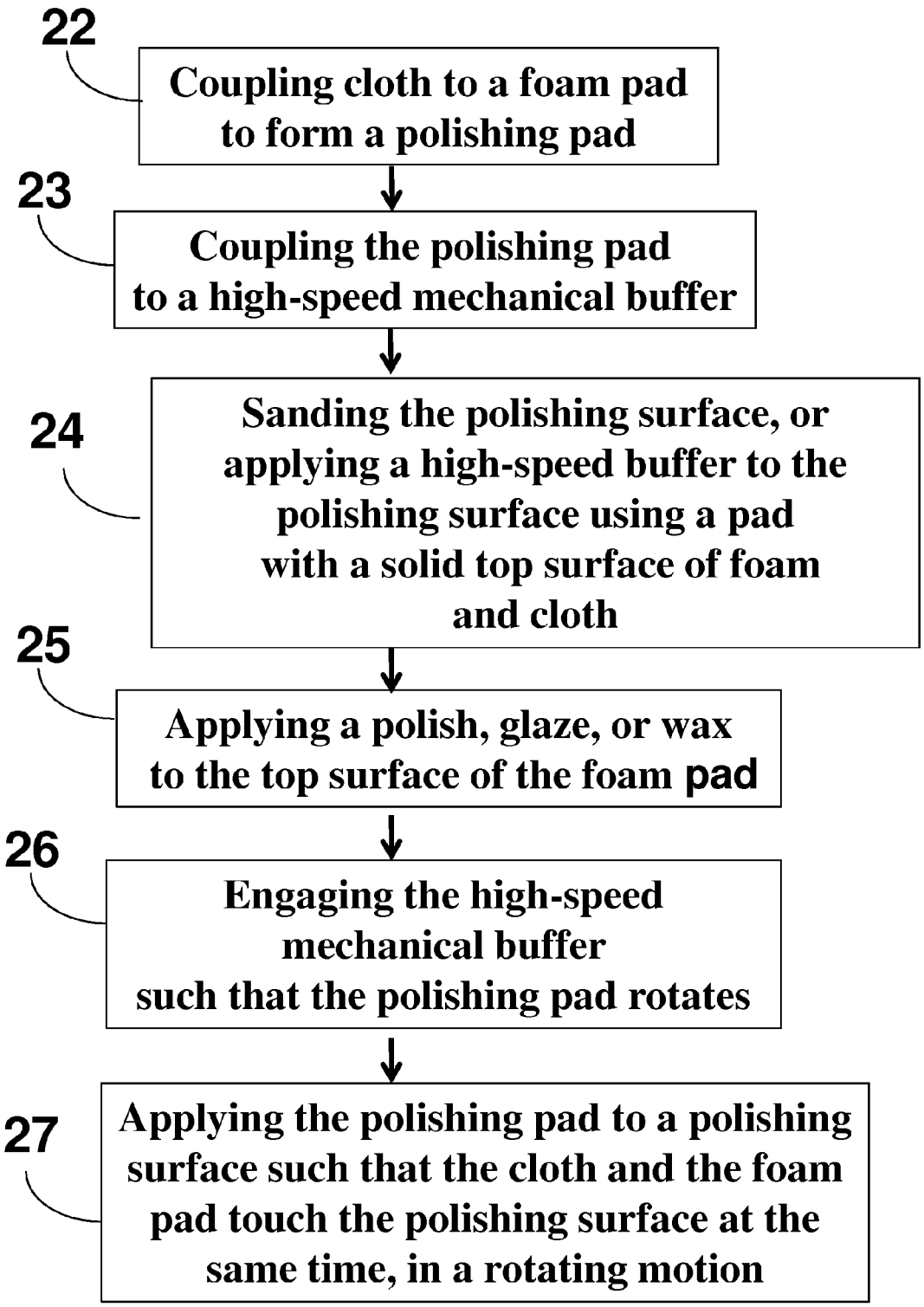
FIG. 10 illustrates an example method of polishing a paint surface to remove a scratch or other irregularity using a polishing pad with a top surface of foam and cloth.

FIG. 10 illustrates an example method of polishing a paint surface to remove a scratch or other irregularity using a polishing pad 1 with a top surface of foam and cloth 2 with surprising results. The provided flowchart indicates an embodiment for a method comprising one or more of: coupling 22 the cloth 2 to a foam pad 3 to form a polishing pad 1, coupling 23 the polishing pad 1 to a high-speed mechanical buffer 28, sanding 24 the polishing surface, or using a polishing pad 1 with a solid top surface of foam and cloth, applying 25 a polish, glaze, or wax to the top surface of the foam pad, engaging 26 the high-speed mechanical buffer 28 such that the polishing pad 1 rotates, and/or applying 27 the polishing pad 1 to a polishing surface such that the cloth 2 and the foam pad 3 touch the polishing surface at the same time, in a rotating motion.

Figure 11A:
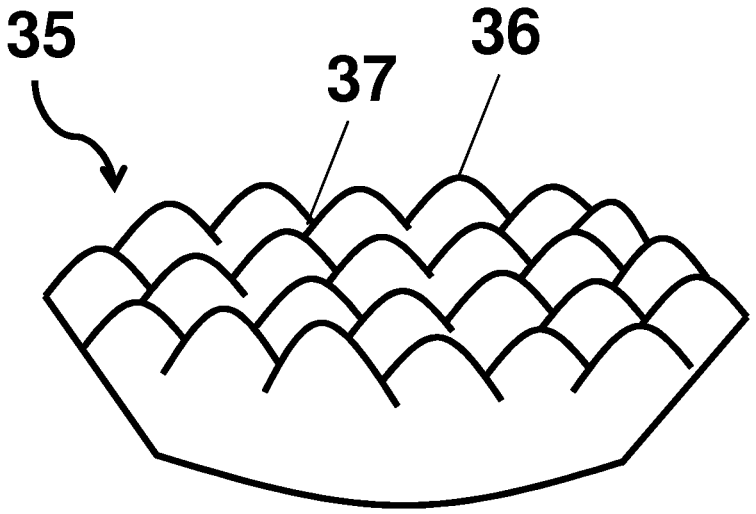
FIGS. 11A-11C illustrate an embodiment of a foam pad in a waffle-pad configuration as described herein.
Figure 11B:
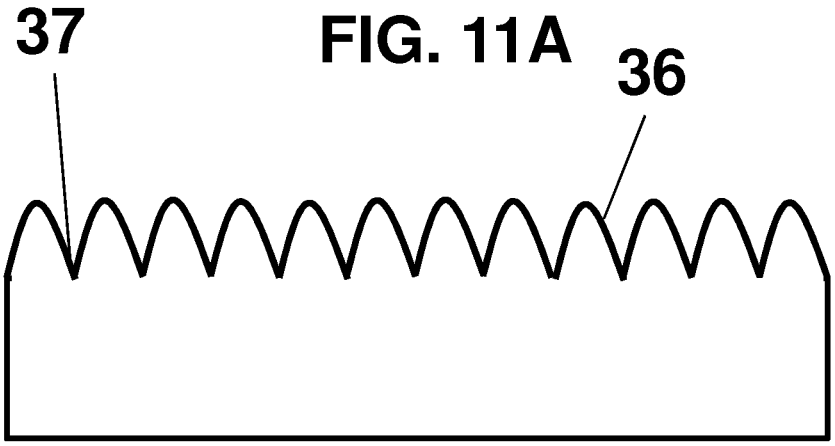
Figure 11C:
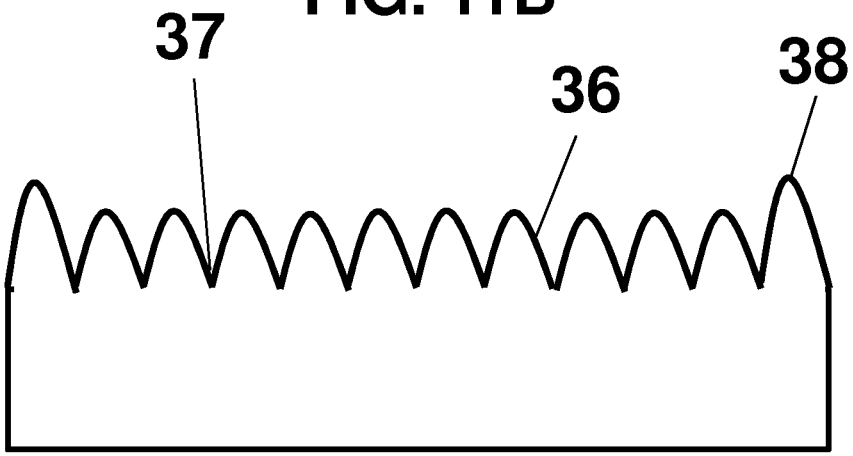

FIGS. 11A-11C illustrate an embodiment of a foam pad 3 in a waffle-pad 35 configuration as described herein. Illustrated in FIG. 11A, which shows a side and top view of the waffle-pad 35, are high points 36 and low points 37 of the waffle-pad 35. FIG. 11B shows a side view of the waffle-pad 35 showing the high points 36 and low points 37. In FIG. 11B the pattern is shown as a series of high points 36 of equal levels, width, and spacing. FIG. 11C shows a side view of the waffle-pad 35, and there are high points 36 and low points 37 as in FIG. 11B. However illustrated in FIG. 11C is that the waffle-pad 35 can a series of high points 36 at one level, and a series of high points 38 at a second level. In specific embodiments there are one or more high points of different levels (such as high point 36 versus high point 38). In specific embodiments there are 1, 2, 3, 4, 5, 6, 7, 8, 9, 10 or more different levels. In specific embodiments there are from 0-5, 0-10, 0-20 different levels. In specific embodiments the low points 37 are of equal depth throughout the waffle-pad 35, and in others there are 1, 2, 3, 4, 5, 6, 7, 8, 9, 10 or more different depths. In specific embodiments there are from 0-5, 0-10, 0-20 different depths.

Embodiments provided herein can include a hand-held version of the polishing pad 1, referring to embodiments within the thinner ranges of foam thicknesses as herein described, having a top surface of foam and/or cloth and/or a foam different from the foam of the foam pad 3 as herein described. A hand-held version can be used in specific methods in addition to use with a high-speed buffer 29. For example, in specific non-limiting embodiments a hand-held polishing pad 1 is about 4 inches in diameter, about 1.5 inches at the thickest point, and about 1 inch at the thinnest point, sloping in about a straight line from one edge to another. In specific embodiments the polishing pad 1 is used in a method of polishing and/or sealing by methods using hand application of polisher and/or sealant. In specific embodiments a circular motion of the polishing pad 1 by hand is used. In specific embodiments the foam pad 3 is a composite foam, with 2, 3, 4, 5, 6, 7, 8, 9, or 10 or more types of foams used together, one or more of which has a different abrasiveness and/or hardness from one or more of the other foam types used. In specific embodiments the foam pad 3 and/or the foam covering the top surface of the pad are comprised of types of foam of 1, 2, 3, 4, 5, 6, 7, 8, 9, or 10 different abrasivenesses. In specific embodiments the foam pad 3 has a top surface of 0, 1, 2, 3, 4, 5, 6, 7, 8, 9, or 10 or more types of foam (and/or another foam or foam composite coupled to the top of the foam pad comprised of 0, 1, 2, 3, 4, 5, 6, 7, 8, 9, or 10 or more types of foam), with or without cloth 2 types (1, 2, 3, 4, 5, 6, 7, 8, 9, or 10 or more different types) in any configuration known. In specific embodiments the foam pad 3 has only a single foam type at the top and without cloth 2, the single foam covering in specific embodiments about 90-100 percent of the top area of the foam pad 3. In specific embodiments the cloth 2 completely covers the foam pad 3 without gaps. In specific embodiments there are two or more types of cloth 2 and/or two or more types of foam at the top surface of the foam pad 3, to be used by hand and/or with a high-speed buffer 29, that are configured such that the two or more types of cloth 2 and/or two or more types of foam touch a polishing surface at the same time upon polishing the surface. In specific embodiments a foam pad 3 has a bonnet made of any material or materials herein described, and the bonnet can be placed over the surface of a foam pad, with or without gaps and with or without two or more cloth 2 types and/or two or more foam types. In specific embodiments the foam pad 3 has no cloth and no second foam type.

Sand paper or other sanding tool used herein can be from about 1200 to 2000 grit, or from about 1200-1500 grit, or from about 1500-2000 grit. In other embodiments, one or more ranges of sand paper or other sanding tool abrasiveness can be used such as: from about 1600-2000, 1700-2000, 1800-2000, 1900-2000, 1600-1700, 1600-1800. 1600-1900, 1200-1300, and/or 1200-1400 grit.

In specific embodiments two polishing pads are used at once on a single machine providing rotation for polishing.

Embodiments provided herein can have a hook and loop backing or other backing so that the polishing pad 1 can be coupled to a high-speed mechanical buffer 28.

Embodiments provided herein can be used with an intermediate piece 34, and the foam pad 3 can be solid foam or include an additional material, such as a second foam type for stabilization.

Embodiments provided herein can be used with an intermediate piece 34, and the foam pad 3 can be solid foam or include an additional material, such as for stabilization. In additional embodiments the additional material is a second foam of a different hardness. The intermediate piece 34 can be a connector of the foam pad 3 to the buffer head 33. This intermediate piece 34 can be VELCRO to adhere together the foam pad 3 to the buffer head 33. The intermediate piece 34 can also be a plastic or metal piece that snaps, screws, or hooks together the foam pad 3 to the buffer head 33.

In specific embodiments the top surface of the polishing pad 1 can be covered with foam, with cloth 2, and with a third material and/or fourth material as described herein or known in the art. The third and/or fourth material can cover about zero to about five percent, or about five to about ten percent, or from about one to about ten percent, or about one to about twenty percent, or about ten to about twenty percent of the top surface area of the polishing pad 1.

Embodiment provided herein can be used on paints such as car paints, as well as other surfaces, such as providing a smooth surface to headlights, windows, or other plastic surfaces having scratches or other imperfections.

Embodiments of polishing pads described herein can be used for one or more of: polishing, glazing, waxing, and/or with polishes, glazes, or waxes.

In specific embodiments the polishing is performed for from about one to about ten minutes or more; in some embodiments the time of engagement of the high-speed mechanical buffer 28 can be in one or more ranges from about: 0-20 minutes, 0-10 minutes, 0-5 minutes, or 5-10 minutes. In specific embodiments a second polishing pad with a foam and cloth 2 top surface is used for polishing for a time of at least one of the ranges provided.

In specific embodiments the foam pad 3 has a substantially flat top surface. In specific embodiments the foam pad 3 is substantially round as viewed from the top surface, though in specific embodiments it can be elliptical or square, or of another shape known in the art, such as those useable with a high-speed mechanical buffer 28.

In specific embodiments the top surface of the polishing pad 1 has segments that are in irregular shapes, regular shapes (meaning homogenous), and in shapes of, for example, hexagonal, round, square, diamond, and/or ellipsoid shape, and/or a combination thereof. In specific embodiments the top surface of the foam pad 3 has these shapes and is thus not perfectly smooth. In specific embodiments at least one of the shapes has a cloth 2 covering, and in other embodiments from about one to about half of the shapes are covered with cloth and in specific embodiments from about one to about half of the shapes of a foam pad 3 are not covered with cloth. In specific embodiments a percentage of one or more shapes is covered, such as from about 1 to about 100 percent of at least one shape being covered by cloth.

The cloth 2 and foam pad 3 can be coupled via one or more of: glue, stitching, hooking, clamping, or adhered in ways known in the art.

Embodiments of the polishing pad 1 described herein can include a hand-held version, referring to an embodiment within the thinner ranges of foam thicknesses as herein described, having a top surface of foam and cloth 2 as herein described; a hand-held version can be used in specific methods in addition to use with a high-speed mechanical buffer 28. For example embodiments can include hand polishing after polishing with a high-speed mechanical buffer, or vice-versa.

In specific embodiments the foam pad 3 and or polishing pad 1 can be formed into a bonnet made of cloth 2 and foam. In specific embodiments the foam has a backing and/or has a core material for stabilizing and providing more support for the foam pad.

Specific embodiments of the polishing pad 1 and/or the foam pad 3 described herein are from about 2 to about 12 inches in diameter, and/or about 4 to about 10 inches, and/or from about 4.5 to about 8 inches, and/or from about 4.5 to about 6.5 inches, and/or about: 4.5 inches, 5 inches, 6.5 inches, 8 inches, and/or 10 inches.

In specific embodiments the polishing pad is about 10.75 inches in diameter and/or about one and three-quarters inches thick. In specific embodiments the polishing pad 1 and/or the foam pad 3 can be in the following ranges: from about 0.1 inch to about 3 inches thick, from about 0.1 inch to 0.5 inches, 1 inch to 3 inches, 1 inch to 2 inches, 2 inches to 3 inches.

Embodiments provided herein can be used with compounds such as one or more of heavy, medium, or light polishes such as: V32, V34, V36, V38, V40.

In specific embodiments the foam pad 3 and the cloth 2 have different abrasivenesses. In specific embodiments a second polishing can be performed with a second polishing pad 1 having a foam and cloth 2 surface, wherein the first and second polishing pads 3 have at least one part of the surface that is different in abrasiveness from the first pad.

The cloth 2 can be comprised of, for example, any microfiber, cotton, microfiber, polyester, polyamide, and polypropylene, wool, hair, silk, flax, or other fiber. In a non-limiting example the cloth 2 is comprised of polyester and polyamide, such as 80 percent polyester and 20 percent polyamide. In other embodiments at least part of or the full area of the cloth 2 has from about 50 to about 100 percent polyester, and/or about 50 to about 60 percent, about 50 to about 70 percent, about 50 to about 80 percent, and/or about 50 to about 90 percent polyester; other polyester percentages in non-limiting embodiments for at least part of the cloth 2 include at least about: 50-60, 60-70, 70-80, 80-90, 90-100 percent. In other embodiments at least part of or the full area of the cloth 2 has from about 50 to about 100 percent polyamide, and/or about 50 to about 60 percent, about 50 to about 70 percent, about 50 to about 80 percent, and/or about 50 to about 90 percent polyamide; other polyamide percentages in non-limiting embodiments for at least part of the cloth 2 include at least about: 50-60, 60-70, 70-80, 80-90, 90-100 percent. In specific embodiments the cloth 2 is in the form of a weave.

In specific embodiments the cloth 2 has a linear mass density of from about 0.7 to about 1.3 denier, and in other embodiments, from about 0.5 to about 1.5 denier, and/or from about 0.7 to about 1 denier, and/or from about 1 to about 1.5 denier, and/or from about 1.1 to about 1.25 denier, and/or from about 1.25 to about 1.3 denier, and/or from about 1.25 to about 1.5 denier.

In specific embodiments cutting, polishing, and glazing are performed with one of the embodiments of the polishing pad 1 described herein.

In specific embodiments the cloth 2 is only present on the top surface of the foam pad 3, and in specific embodiments the cloth 2 is only coupled to the top surface of the foam pad 3.

In specific embodiments of methods of use for the polishing pad 1 comprise one or more of: coupling cloth 2 to a foam pad 3 to form a polishing pad 1, coupling the polishing pad 1 to a high-speed mechanical buffer 28, applying a polish, glaze, or wax to the top surface of the foam pad 3, engaging the high-speed mechanical buffer 28 such that the polishing pad 1 rotates, and/or applying the polishing pad 1 to a polishing surface such that the cloth 2 and the foam pad 3 touch the polishing surface at the same time, in a rotating motion.

Specific embodiments herein can use, in part or in full, one or more of a device or method wherein: the cloth 2 extends out from the top surface of the foam pad 3, the cloth 2 extending above the top surface of the foam pad 3 as viewed from the side of the polishing pad 1; the foam pad 3 has a top surface that is substantially circular, the foam pad 3 has a top surface diameter of from about 2 to about 12 inches, the foam pad 3 has a thickness of from about 1 to about 3 inches; the cloth 2 coupled exclusively on the top surface of the polishing pad 1; the foam pad 3 comprises a composite comprising at least two foams of different abrasivenesses from each other and from the abrasivenesses of the at least one of the cloth 2 and the foam covering part of the top surface of the foam pad 3; the polishing pad 1 comprising the cloth 2 and the foam; the polishing pad 1 wherein the cloth 2 is comprised of a microfiber that in specific embodiments can be coupled exclusively on the top surface of the polishing pad 1; the polishing pad 1 wherein the cloth 2 is selected from at least one of cotton, polyester, polyamide, and polypropylene, wool, hair, silk, flax; the polishing pad 1 has a central cloth 2 covering area; the foam pad 3 of the polishing pad 1 has a waffle-pad configuration; the polishing pad 1 has a central cloth 2 covering area and a section extending out from the central cloth 2 covering area which is bounded on each side by one of the gaps, the section extending out from the central cloth 2 covering area toward the polishing pad 1 perimeter such that the portion of the extending section near the center has a width that increases in the direction from the center to the periphery of the polishing pad 1, reaches a peak at about the middle of the extending section, and then decreases in width at the periphery of the polishing pad 1; the cloth 2 has from about 1 section to about 5 sections extending out from the central covering area to the periphery of the polishing pad 1, each extending area of cloth 2 having a gap on each side of uncovered foam pad; the top surface of the foam pad 3 is substantially flat throughout; the foam pad 3 comprises a composite comprising at least two foams of different abrasivenesses from each other and from the abrasivenesses of the at least one of the cloth 2 and the foam covering part of the top surface of the foam pad 3; the top surface of the foam pad 3 has a pattern of shapes as viewed from the top, the shapes being selected from at least one of hexagonal, round, elliptical, square, and diamond shaped, and the cloth 2 covering from about one to about half the total shapes; the foam pad 3 and the cloth 2 are formed into a bonnet; polishing the polishing surface with the polishing pad 1 such that cloth 2 touches the polishing surface at a time when the foam pad 3 does not; coupling the polishing pad 1 to a high-speed mechanical buffer 28 and engaging the high-speed mechanical buffer 28 such that the polishing pad 1 rotates at from about 1000 to about 3000 rotations per minute; applying a polish to the top surface of the polishing pad 1 and applying the polishing pad 1 to a polishing surface such that the cloth 2 and the foam pad 3 touch the polishing surface at the same time; polishing the car surface of paint with a second polishing pad having a top surface of the foam and a second cloth, the second cloth having a different abrasiveness as the first; wherein the polishing surface is at least one of a car surface of paint, a car headlight, a car window; and/or wherein the polishing surface comprises a surface of paint from a car.

The invention claimed is:

1. A polishing pad for use with high-speed mechanical buffers or for use by hand comprising:

a foam pad; and at least one of a cloth and a foam that are each different in abrasiveness than the foam pad coupled to a top surface of the foam pad, the at least one of the cloth and the foam covering part of the top surface of the foam pad such that gaps in the coverage provided by the at least one of the cloth and the foam allow for the foam pad and the at least one of the cloth and the foam to touch a polishing surface at the same time; and wherein the foam pad of the polishing pad comprises a waffle-pad configuration.

2. The polishing pad of claim 1 wherein the cloth extends out from the top surface of the foam pad, the cloth extending above the top surface of the foam pad as viewed from the side of the polishing pad.

3. The polishing pad of claim 1 wherein the top surface of the foam pad is substantially circular and has a diameter of from about 2 to about 12 inches, and the foam pad has a thickness of from about 1 to about 3 inches, and wherein the foam pad comprises a composite comprising at least two foams of different abrasivenesses from each other and from the abrasivenesses of the at least one of the cloth and the foam covering part of the top surface of the foam pad.

4. The polishing pad of claim 1 wherein the cloth is comprised of a microfiber coupled exclusively on the top surface of the polishing pad.

5. The polishing pad of claim 1 wherein the cloth is selected from at least one of cotton, polyester, polyamide, and polypropylene, wool, hair, silk, and flax.

6. The polishing pad of claim 1 wherein the polishing pad has a central cloth covering area and a section extending out from the central cloth covering area which is bounded on each side by one of the gaps, the section extending out from the central cloth covering area toward a polishing pad perimeter such that a portion of an extending section near a center has a width that increases in a direction from the center to a periphery of the polishing pad, reaches a peak at about the middle of the extending section, and then decreases in the width at the periphery of the polishing pad.

7. The polishing pad of claim 1 wherein the cloth has from about 1 section to about 5 sections extending out from a central cloth covering area to a periphery of the polishing pad, each extending area of cloth having one of the gaps on each side.

8. The polishing pad of claim 1 wherein the foam pad comprises a composite comprising at least two foams of different abrasivenesses from each other and from the abrasivenesses of the at least one of the cloth and the foam covering part of the top surface of the foam pad.

9. The polishing pad of claim 1 wherein the top surface of the foam pad has a pattern of shapes as viewed from the top, the shapes being selected from at least one of hexagonal, round, elliptical, square, and diamond shaped, and the cloth covering from about one to about half of the area of the top surface of the foam pad.

10. A method of removing imperfections from a polishing surface comprising:

providing a polishing pad comprising:

a foam pad; and a cloth coupled to a top surface of the foam pad, the cloth covering part of the top surface of the foam pad such that gaps in coverage provided by the cloth allow for the cloth and the foam pad to touch the polishing surface at the same time; and polishing the polishing surface with the polishing pad such that the cloth and the foam pad touch the polishing surface at a same time; and polishing the polishing surface with the polishing pad such that the cloth touches the polishing surface at a time when the foam pad does not.

11. The method of claim 10 further comprising coupling the polishing pad to a high-speed mechanical buffer and engaging the high-speed mechanical buffer such that the polishing pad rotates at from about 1000 to about 3000 rotations per minute.

12. The method of claim 10 further comprising applying a polish to the top surface of the polishing pad and applying the polishing pad to the polishing surface, the polishing surface being a car surface of paint.

13. The method of claim 10 further comprising polishing the polishing surface with a second polishing pad comprising a top surface of the foam and a second cloth, the second cloth having a different abrasiveness as the first.

14. The method of claim 13 wherein the polishing surface is at least one of a car surface of paint, a car headlight, and a car window.

15. A polishing pad for use with high-speed mechanical buffers or for use by hand comprising:

a foam pad; and at least one of a cloth and a foam that are each different in abrasiveness than the foam pad coupled to a top surface of the foam pad, the at least one of the cloth and the foam covering part of the top surface of the foam pad such that gaps in the coverage provided by the at least one of the cloth and the foam allow for the foam pad and the at least one of the cloth and the foam to touch a polishing surface at the same time; and wherein the foam pad and the cloth are formed into a bonnet.

* * * * *